United States Patent [19]

Isaf

[11] Patent Number: 4,820,234

[45] Date of Patent: Apr. 11, 1989

[54] DOLL HAVING A PLURALITY OF WHEELS WITH VARYING FACIAL EXPRESSIONS TO EFFECT MOOD CHANGES

[76] Inventor: Asad F. Isaf, 38 Homer Ave., Cortland, N.Y. 13045

[21] Appl. No.: 107,677

[22] Filed: Oct. 13, 1987

[51] Int. Cl.[4] ..... A63H 3/16; A63H 3/44

[52] U.S. Cl. ..... 446/321; 446/100; 446/117; 446/337; 446/394

[58] Field of Search ..... 446/99, 100, 101, 117, 446/321, 337, 391, 394, 395

[56] References Cited

U.S. PATENT DOCUMENTS

| | | | |
|---|---|---|---|
| 702,615 | 6/1902 | Barden | 446/117 X |
| 1,138,412 | 5/1915 | Radick | 446/321 |
| 1,272,685 | 7/1918 | Levis | 446/117 X |
| 1,496,406 | 6/1924 | Bertsch | 446/341 |
| 1,762,374 | 6/1930 | Yancey | 446/321 X |
| 2,584,798 | 2/1952 | Goerditz | 446/321 |
| 4,030,239 | 6/1977 | White et al. | 446/321 |
| 4,136,483 | 1/1979 | Shackelford et al. | 446/321 |
| 4,509,920 | 3/1985 | Kaufmann | 446/100 X |

FOREIGN PATENT DOCUMENTS

| | | | |
|---|---|---|---|
| 1506324 | 12/1967 | France | 446/99 |

*Primary Examiner*—Robert A. Hafer
*Assistant Examiner*—Charles H. Harris
*Attorney, Agent, or Firm*—Louis T. Isaf

[57] ABSTRACT

A novelty doll is comprised of a plurality of independent and exchangeable facial segments which are built upon a post to create a doll face, each facial segment including a plurality of expressions selectively and separately placed into view whereby a variety of humorous moods and expressions are depicted by the novelty doll.

10 Claims, 3 Drawing Sheets

DOLL HAVING A PLURALITY OF WHEELS WITH VARYING FACIAL EXPRESSIONS TO EFFECT MOOD CHANGES

FIELD AND BACKGROUND OF INVENTION

The present invention relates to the field of novelty items and/or the field of dolls; and the invention addresses a humorous need to mimic the mood or expressions of the owner or another person being mimicked by the owner.

BRIEF DESCRIPTION OF THE INVENTION

Briefly described, the present invention is a doll comprised of a plurality of independent body pieces stacked on top of each other on a post member. Each independent body piece rotates independently about the post member and includes thereon a plurality of related but differently depicted body parts. For example, in the preferred embodiment, one body piece is the nose wheel which depicts thereon a plurality of different shaped noses at spaced apart locations about the periphery of the nose wheel; an eye wheel depicts a plurality of eye pairs of differing expressions dispersed about the periphery of the wheel; and the mouth wheel depicts a plurality of mouth expressions dispersed about the periphery of the wheel. A hair wheel, if desired, tops off the doll.

Different combinations of moods and expressions can be depicted by the doll by "dialing" a different alignment of eyes, noses, and mouths.

The wheels are held in place on the post member by a nut within the hair piece or within a separate hat piece.

If is, therefore, an object of the present invention to provide a novelty doll capable of displaying a multitude of varying expressions and moods.

Another object of the present invention is to provide a novelty doll which is easily disassembled into pieces which are exchangeable with substitute features to provide an increasing variety of expressions and depicted moods.

Other objects, features and advantages of the present invention will become apparent upon reading and understanding this specification when taken in conjunction with the accompanying drawings.

DETAILED DESCRIPTION OF THE PREFERRED EMBODIMENT

Figure 1:
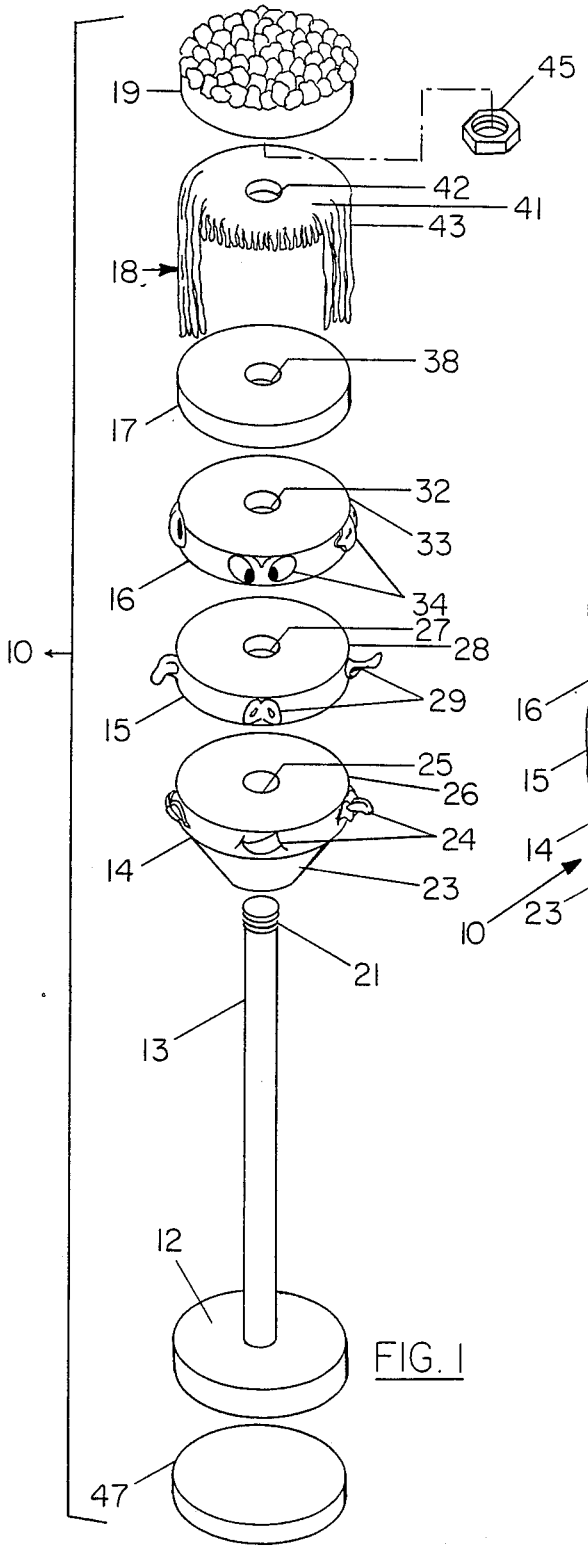
FIG. 1 is a pictorial, exploded view of the novelty doll in accordance with the present invention, depicting one embodiment thereof.
Figure 2:
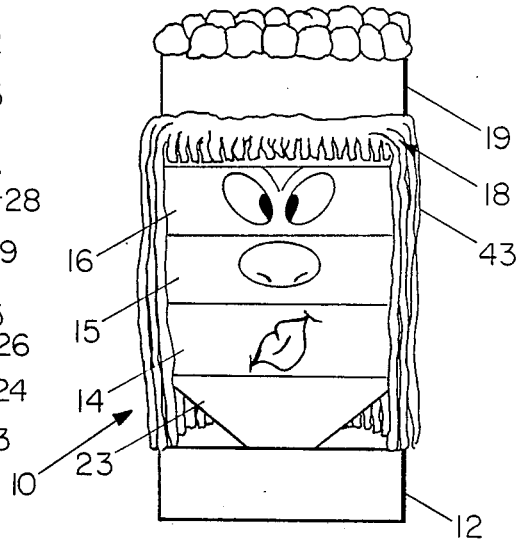
FIG. 2 is a front view of an assembled novelty doll of FIG. 1.

Referring now in greater detail to the drawings in which like numerals represent like components throughout the several views, FIG. 1 shows the novelty doll 10 of a preferred embodiment of the present invention as comprising a base 12, support post 13, mouth-chin-neck wheel 14, nose wheel 15, eye wheel 16, forehead wheel 17, hair piece 18 and hat piece 19.

The base 12 and support post 13 define, preferably, a one unit item including the base and support post. The top of the support post 13 is defined with a threaded section 21.

Figure 3B:
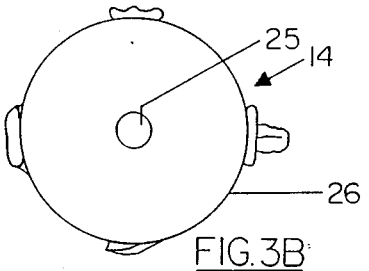
FIG. 3B is a top view of the wheel of FIG. 3A.
Figure 3A:
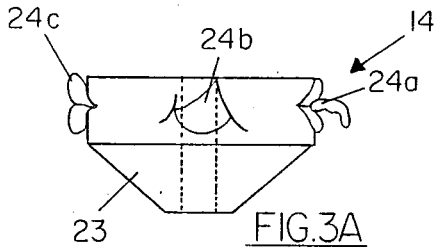
FIG. 3A is a front view of the mouth-chin-neck wheel of the embodiment of FIG. 1.

The mouth-chin-neck wheel 14 (seen also in FIGS. 3A and 3B) is, preferably, a disk shaped member which is tapered to indicate a neck area 23. Four different mouth expressions 24*a*–24*d* are defined on the mouth wheel above the neck area 23. The mouth expressions are defined by any acceptable method, including painting, engraving, carving or gluing of separately carved segments. Each mouth expression 24 (24*a*–24*d*) is located about the periphery 26 of the mouth wheel 14 approximately ninety degrees displaced from the next, adjacent mouth expression. In an alternate embodiment, the neck area 23 comprises a separate wheel, separate from the mouth wheel 14 and is provided with a plurality of chin types (i.e. double chin, beard, goatee, etc.) The mouth-chin-neck wheel 14 has a central opening 25 and slides over the post 13 to its base 12.

Figure 4B:
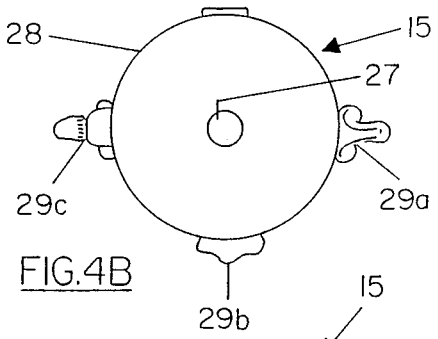
FIG. 4B is a top view of the wheel of FIG. 4A.
Figure 4A:
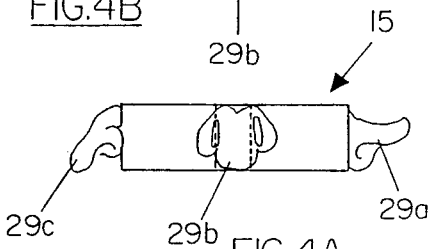
FIG. 4A is a side view of the nose wheel of the embodiment of FIG. 1.

The nose wheel 15 (seen also in FIGS. 4A and 4B) is disk shaped having a central opening 27 and an outer periphery 28. The nose wheel 15 is formed with four different nose styles defined thereon by painting, engraving, carving or otherwise at the outer periphery 28 of the wheel. Each nose 29 is located at the periphery 28 displaced approximately ninety degrees from the adjacent nose types (29*a*–29*d*). The nose wheel 15 slides over the post 13 and rests upon the mouth wheel 14.

Figure 5B:
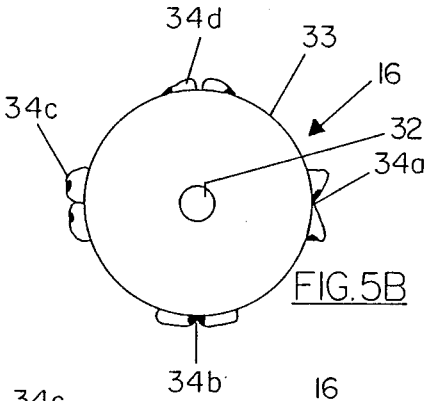
FIG. 5B is a top view of FIG. 5A.
Figure 5A:
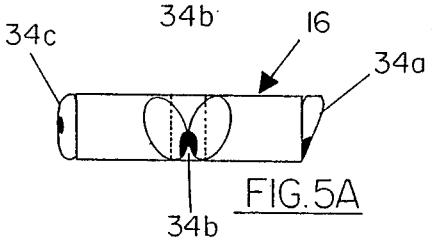
FIG. 5A is side view of an eye wheel from the embodiment of FIG. 1.

The eye wheel 16 (seen also in FIGS. 5A and 5B) is a disk shaped member including a central opening 32 and an outer periphery 33. The eye wheel 15 has four different eye expressions 34 (34*a*–34*d*) defined along the outer periphery 33 of the wheel. The eye expressions 34 are defined by painting, engraving, carving or other appropriate techniques and are located along the outer periphery 33 with each eye expression 34*a*–34*d* displaced approximately ninety degrees from its adjacent eye expressions. The eye wheel 16 slides over the post 13 and rests on top of the nose wheel 15.

Figure 6:
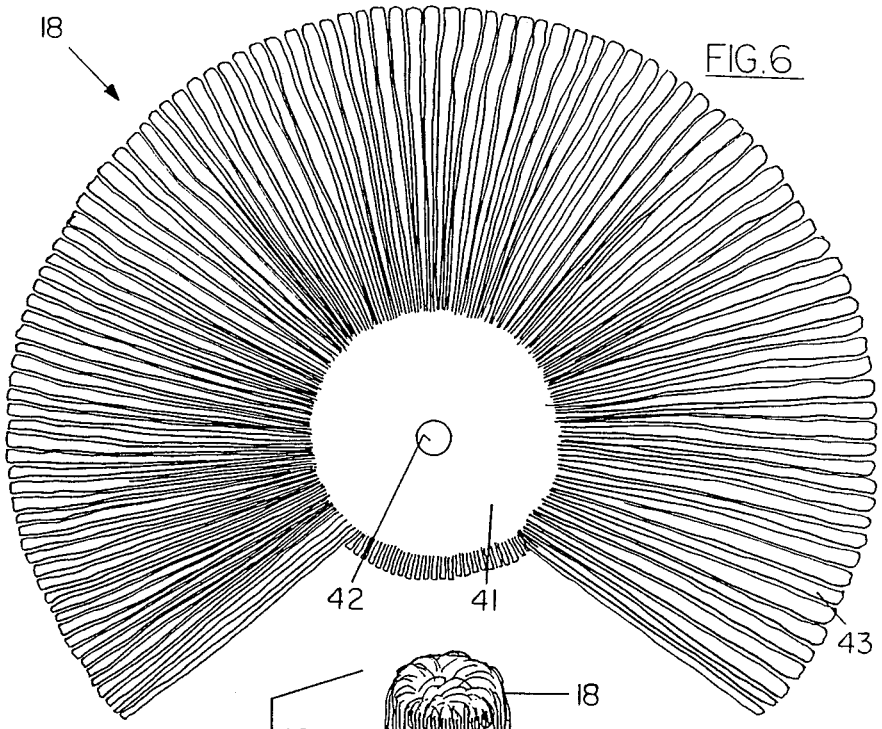
FIG. 6 is a top view of the hair piece of the embodiment of FIG. 1.

The forehead wheel 17 is a disk shaped member including a central opening 38 and slides over the post 13 to act as a spacer between the eye wheel 16 and hair piece 18. The forehead wheel in alternate embodiments is formed with varying expressions such as wrinkles. The hair piece 18, seen also in FIG. 6, includes a semi-rigid member 41 which includes a central opening 42 and from which protrudes "hair" 43. The hair 43 is formed of nylon threads, cloth or other material having stringy effect. Preferably, the hair 43 is long and cut as seen in FIG. 6 in order that, when the hair piece 18 is placed on the post 13 resting on the forehead wheel 17, the hair will extend down over the eye wheel 16, nose wheel 15 and mouth wheel 14 and will hide three out of the four expressions on each of the wheels.

Figure 7B:
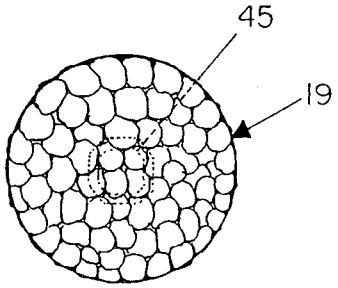
FIG. 7B is a top view of FIG. 7A.
Figure 7A:
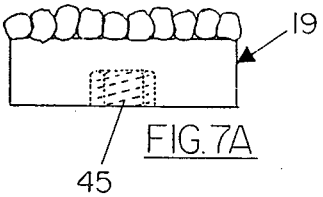
FIG. 7A is a side view of the hat piece of the embodiment of FIG. 1.
Figure 8:
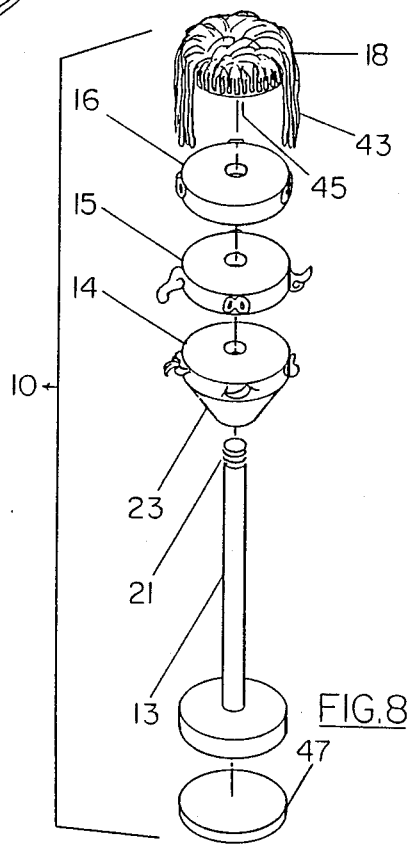
FIG. 8 is a pictorial, exploded view of the novelty doll in accordance with the present invention, depicting an alternate embodiment to that of FIG. 1.

The hat piece 19 (seen also in FIGS. 7A and 7B) is of any desired type and shape of hat and is shown as an example in the drawings as a crown. A nut 45 is secured firmly to the underside and inside the hat piece 19. In an alternate embodiment, the nut 45 is replaced by a threaded bore formed directly in the underside of the hat piece 19. Thus, the hat piece 19 is threaded to the threaded section 21 of the post 13 and holds the complete assembly together, preventing the various facial expression wheels from rotating inadvertantly and from falling off the post. In alternate embodiments, the hat piece 19 is eliminated and the hair piece 18 is shaped to depict a head with hair on its, or balding on top; and the nut 45 is secured within this hair piece. Also, in alternate embodiments, the forehead wheel 17 and hair piece 18 are formed as one piece. See FIG. 8.

In the preferred embodiment, the novelty doll 10 also comprises a magnet and/or cushion 47 secured to the bottom of the base 12 for cushioning placement of the doll stand on a surface or for holding the doll to a metal surface. In alternative embodiments, the base 12 is formed with a suction cup design; or string is connected to the hat piece to hang the doll 10 for display. Furthermore, in preferred embodiments of the present invention, the novelty doll is provided with two or more eye wheels 16, nose wheels 15, and mouth wheels 14 each with still differing expressions and nose types so that a greater number of moods and expressions can be created. The nose wheel 15 and eye wheel 16, and the mouth wheel 14 (in embodiments where the neck area 23 is separate) are inverted to provide still greater variety of expressions. Preferably, there are a plurality of hair pieces depicting different colored hair.

When all parts are assembled as discussed above, the hat piece 19 (or forehead wheel/hair piece 18 in the alternate embodiment) is screwed down with light pressure on the threaded section 21 of the post 13. This will keep the facial wheels 14, 15, 16, 17 from rotating. To change the expressions, unscrew the hat piece 19 slightly, rotate or "dial" the appropriate facial feature wheel 15, 16, 17 to the desired expression; then lightly tighten the hat piece again to hold the chosen expression. To invert a selected wheel or to exchange one wheel or piece with a substitute, the hat piece 19 (or forehead wheel/hair piece is unscrewed, appropriate sections taken off the post 13 and replaced, and the doll is reassembled.

Whereas the present invention has been described in detail with particular reference to preferred embodiments thereof, it is understood that variations and modifications can be effected within the spirit and scope of the invention as described herein before and as defined in the appended claims.

I claim:

1. A novelty doll, comprising:

a base and a post supported by said base;

a mouth wheel removably supported on said post and including a disk-shaped portion rotatable about said post and a plurality of mouth expressions formed along the periphery of said disk-shaped portion, each mouth expression displaced radially about said mouth wheel from the adjacent mouth expressions;

a nose wheel removably supported on said post above said mouth wheel, said nose wheel including a disk-shaped portion rotatable about said post and a plurality of nose types formed along the periphery of said disk-shaped nose wheel, each nose type displaced radially about said nose wheel from the adjacent nose types;

an eye wheel removably supported on said post above said nose wheel, said eye wheel including a disk-shaped portion rotatable about said post and a plurality of eye expressions formed along the periphery of said disk-shaped eye wheel, each eye expression displaced radially about said eye wheel from the adjacent eye expressions;

a top piece supported on said post with said mouth wheel, nose wheel and eye wheel positioned between said base and said top piece;

means associated with said top piece and said post for removably connecting said top piece to said post and for releasably clamping said eye, ear and nose wheels, and hair extending over said eye, nose and mouth wheels to cover all but one mouth expression, nose type and eye expression on each respective wheel;

each said mouth wheel, nose wheel and eye wheel being separately rotatable on said post to align varying and selectable combinations of mouth expressions, nose types and eye expressions.

2. Doll of claim 1, further comprising a neck wheel mounted on said post below said mouth wheel, said neck wheel including a plurality of spaced apart neck-chin-beard types formed thereon.

3. Doll of claim 2, wherein said neck wheel is integrally formed from and rotates with said mouth wheel.

4. Doll of claim 2, wherein said neck wheel rotates on said post independently of said mouth wheel.

5. Doll of claim 1, wherein said means for removably connecting and for releasably clamping comprises, at least, an externally threaded portion formed on said post and an internally threaded portion defined in said top piece, said internally threaded portion being selectively threaded into and off of said externally threaded portion to removably connect said top piece to said post and said internally threaded portion being selectively advanced and retracted along said externally threaded portion to releasably clamp said eye, ear and nose wheels between said base and said top piece.

6. Doll of claim 5, wherein said internally threaded portion defined in said top piece comprises a nut embedded within said top piece.

7. Doll of claim 1, wherein said top piece comprises at least one of a forehead wheel, hat piece and hairpiece.

8. Doll of claim 1, further comprising at least one of the following: a second mouth wheel interchangable with said mouth wheel; a second nose wheel interchangable with said nose wheel; a second eye wheel interchangable with said eye wheel.

9. Doll of claim 1, wherein said hair is attached to said top piece.

10. Doll of claim 1, further comprising a hair piece to which said hair is attached said hair piece is removably supported on said post between said top piece and said base.

* * * * *